US009657596B2

(12) United States Patent
Svihla

(10) Patent No.: US 9,657,596 B2
(45) Date of Patent: May 23, 2017

(54) TURBINE HOUSING ASSEMBLY FOR A TURBOCHARGER

(71) Applicant: Electro-Motive Diesel, Inc., LaGrange, IL (US)

(72) Inventor: Gary R. Svihla, Burr Ridge, IL (US)

(73) Assignee: Electro-Motive Diesel, Inc., LeGrange, IL (US)

( * ) Notice: Subject to any disclaimer, the term of this patent is extended or adjusted under 35 U.S.C. 154(b) by 418 days.

(21) Appl. No.: 14/498,660

(22) Filed: Sep. 26, 2014

(65) Prior Publication Data

US 2016/0090865 A1 Mar. 31, 2016

(51) Int. Cl.
*F01D 25/24* (2006.01)

(52) U.S. Cl.
CPC ..... *F01D 25/243* (2013.01); *F05D 2220/40* (2013.01); *F05D 2230/642* (2013.01); *F05D 2260/30* (2013.01)

(58) Field of Classification Search
CPC .. F01D 25/24; F01D 25/243; F05D 2230/642; F05D 2260/30; F05D 2220/40; F16M 1/04; F02B 37/00; F02C 3/04
See application file for complete search history.

(56) References Cited

U.S. PATENT DOCUMENTS 3,664,674 A * 5/1972 Yehl ..... F01D 25/243 277/637
4,171,936 A * 10/1979 Hageman ..... F02B 37/18 417/407
4,235,484 A * 11/1980 Owen ..... F01D 25/166 184/6.11
4,240,678 A * 12/1980 Sarle ..... F01D 25/166 384/369
4,643,044 A * 2/1987 Bitton ..... F01C 21/104 277/641
4,704,075 A * 11/1987 Johnston ..... F01D 25/125 417/407
4,969,805 A * 11/1990 Romeo ..... F01D 25/24 417/360
5,026,260 A * 6/1991 Gutknecht ..... F01D 25/125 184/6.11

(Continued)

FOREIGN PATENT DOCUMENTS

WO WO 2013/148412 A1 10/2013

*Primary Examiner* — Gregory Anderson
*Assistant Examiner* — Wayne A Lambert
(74) *Attorney, Agent, or Firm* — Finnegan, Henderson, Farabow, Garrett & Dunner, LLP

(57) ABSTRACT

A turbine housing assembly is disclosed. The turbine housing assembly may have a turbine housing. The turbine housing may have a turbine housing flange. The turbine housing assembly may also have a bearing housing having a boss extending from a compressor end to a turbine end opposite the compressor end. The bearing housing may also have a bearing housing flange abutting on the turbine housing flange. The bearing housing flange may be disposed between the compressor end and the turbine end. The turbine housing assembly may also have a clamping plate abutting on the turbine housing flange and the boss. Further the turbine housing assembly may have a backing plate abutting on the clamping plate. In addition, the turbine housing assembly may have a fastener disposed within the boss and attached to the backing plate.

14 Claims, 6 Drawing Sheets

(56) References Cited

U.S. PATENT DOCUMENTS

| | | | | |
|---|---|---|---|---|
| 5,116,158 | A * | 5/1992 | Carruthers | F01D 25/005 403/28 |
| 5,549,449 | A * | 8/1996 | McInerney | F01D 25/14 384/413 |
| 6,354,815 | B1 * | 3/2002 | Svihla | F01D 25/145 417/407 |
| 6,371,238 | B1 * | 4/2002 | Svihla | F01D 25/28 180/296 |
| 6,464,268 | B1 * | 10/2002 | Hough | F16L 23/08 285/367 |
| 2010/0054934 | A1 * | 3/2010 | Boning | F01D 25/243 415/214.1 |
| 2010/0189558 | A1 * | 7/2010 | Boning | F01D 25/243 415/203 |
| 2011/0083433 | A1 * | 4/2011 | Stroph | F01D 9/026 60/605.1 |
| 2011/0254268 | A1 * | 10/2011 | Johnson | F16L 23/08 285/407 |
| 2011/0299983 | A1 | 12/2011 | Delitz | |
| 2013/0004291 | A1 | 1/2013 | Williams | |
| 2013/0047605 | A1 | 2/2013 | Drangel et al. | |
| 2013/0272870 | A1 | 10/2013 | Weber et al. | |
| 2014/0099196 | A1 | 4/2014 | Lingenauber et al. | |
| 2014/0248146 | A1 * | 9/2014 | Sander | F02C 7/20 415/213.1 |
| 2014/0341732 | A1 * | 11/2014 | Friedrich | F01D 25/16 415/229 |
| 2016/0084166 | A1 * | 3/2016 | Svihla | F02C 7/20 60/605.1 |

* cited by examiner

TURBINE HOUSING ASSEMBLY FOR A TURBOCHARGER

TECHNICAL FIELD

The present disclosure relates generally to a turbine housing assembly and, more particularly, to a turbine housing assembly for a turbocharger.

BACKGROUND

Internal combustion engines, for example, diesel engines, gasoline engines, or natural gas engines employ turbochargers to deliver compressed air for combustion in the engine. A turbocharger compresses air flowing into the engine, helping to force more air into the combustion chambers of the engine. The increased supply of air allows increased fuel combustion in the combustion chambers of the engine, resulting in increased power output from the engine.

A typical turbocharger includes a shaft, a turbine wheel attached to one end of the shaft, a compressor impeller connected to the other end of the shaft, and bearings to support the shaft. Often a turbine housing surrounds the turbine wheel and a separate compressor housing surrounds the compressor impeller. In addition, the turbocharger may include a bearing housing that surrounds the bearings and includes features that help prevent leakage of bearing lubrication oil into the turbine housing or the compressor housing. The turbine housing, the compressor housing, and the bearing housing are attached to each other via fasteners or other clamping mechanisms.

Hot exhaust from the engine flows through the turbine housing and expands over the turbine wheel, rotating the turbine wheel and the shaft connected to the turbine wheel. The shaft in turn rotates the compressor impeller. Relatively cool air from the ambient flows through the compressor housing where the compressor impeller compresses the air and drives the compressed air into the combustion chambers of the engine. Because the exhaust from the engine is significantly hotter than the ambient air, the turbine housing can experience temperatures significantly higher than the compressor housing. The bearing housing, lying between the turbine housing and the compressor housing, experiences temperatures relatively lower than that of the turbine housing and relatively higher than that of the compressor housing. Because of the different temperatures of the turbine housing, the compressor housing, and the bearing housing, these components may experience different amounts of thermal expansion. The differential thermal expansion causes relative motion between the turbine housing, the compressor housing, and the bearing housing, making it difficult to keep these components securely fastened to each other during operation of the turbocharger. Moreover, the relative motion may also induce mechanical fatigue in the connecting fasteners, reducing the useful life of the fasteners.

One attempt to address some of the problems described above is disclosed in U.S. Patent Application Publication No. 2011/0299983 of Delitz published on Dec. 8, 2011 ("the '983 publication"). In particular, the '983 publication discloses a connection assembly of a turbine housing to a bearing housing. The '983 publication discloses that the bearing housing is connected to the turbine housing by means of a connection device in the form of a V collar clamp. The '983 publication also discloses that a heat shield is arranged between the bearing housing and the turbine housing to prevent heat from being transferred from the turbine housing to the bearing housing. The '983 publication discloses that the heat shield extends to a region between the contacting flange shaped portions of the turbine housing and the bearing housing.

Although the connection assembly disclosed in the '983 publication attempts to minimize the transfer of heat from the turbine housing to the bearing housing, the disclosed connection assembly may still be less than optimal. In particular, by preventing the flow of heat from the turbine housing to the bearing housing, the heat shield of the '983 publication may exacerbate the differences in thermal expansion of the bearing housing and the turbine housing. The disclosed V clamp of the '983 publication may also be subject to mechanical fatigue because of the differential expansion between the bearing housing and the turbine housing. Further, because the V clamp of the '983 publication resides external to the bearing housing and the turbine housing, the V clamp may be exposed to moisture and other corrosive elements, which may degrade the V clamp and reduce its useful life.

The turbine housing assembly of the present disclosure solves one or more of the problems set forth above and/or other problems of the prior art.

SUMMARY

In one aspect, the present disclosure is directed to a turbine housing assembly. The turbine housing assembly may include a turbine housing. The turbine housing may include a turbine housing flange. The turbine housing assembly may also include a bearing housing having a boss extending from a compressor end to a turbine end opposite the compressor end. The bearing housing may include a bearing housing flange abutting on the turbine housing flange. The bearing housing flange may be disposed between the compressor end and the turbine end. The turbine housing assembly may also include a clamping plate abutting on the turbine housing flange and the boss. Further the turbine housing assembly may include a backing plate abutting on the clamping plate. In addition, the turbine housing assembly may include a fastener disposed within the boss and attached to the backing plate.

In another aspect, the present disclosure is directed to a turbocharger housing connection. The turbocharger housing connection may include a washer configured to abut on a front face of a compressor housing flange. The turbine housing connection may further include a clamping plate configured to abut on a rear face of a boss of a bearing housing and on a turbine housing flange. The turbine housing connection may also include a backing plate configured to abut on the clamping plate. The backing plate may include a hole having threads. The turbine housing connection may include a fastener configured to pass through the boss and engage with the threads in the hole.

DETAILED DESCRIPTION

Figure 1:
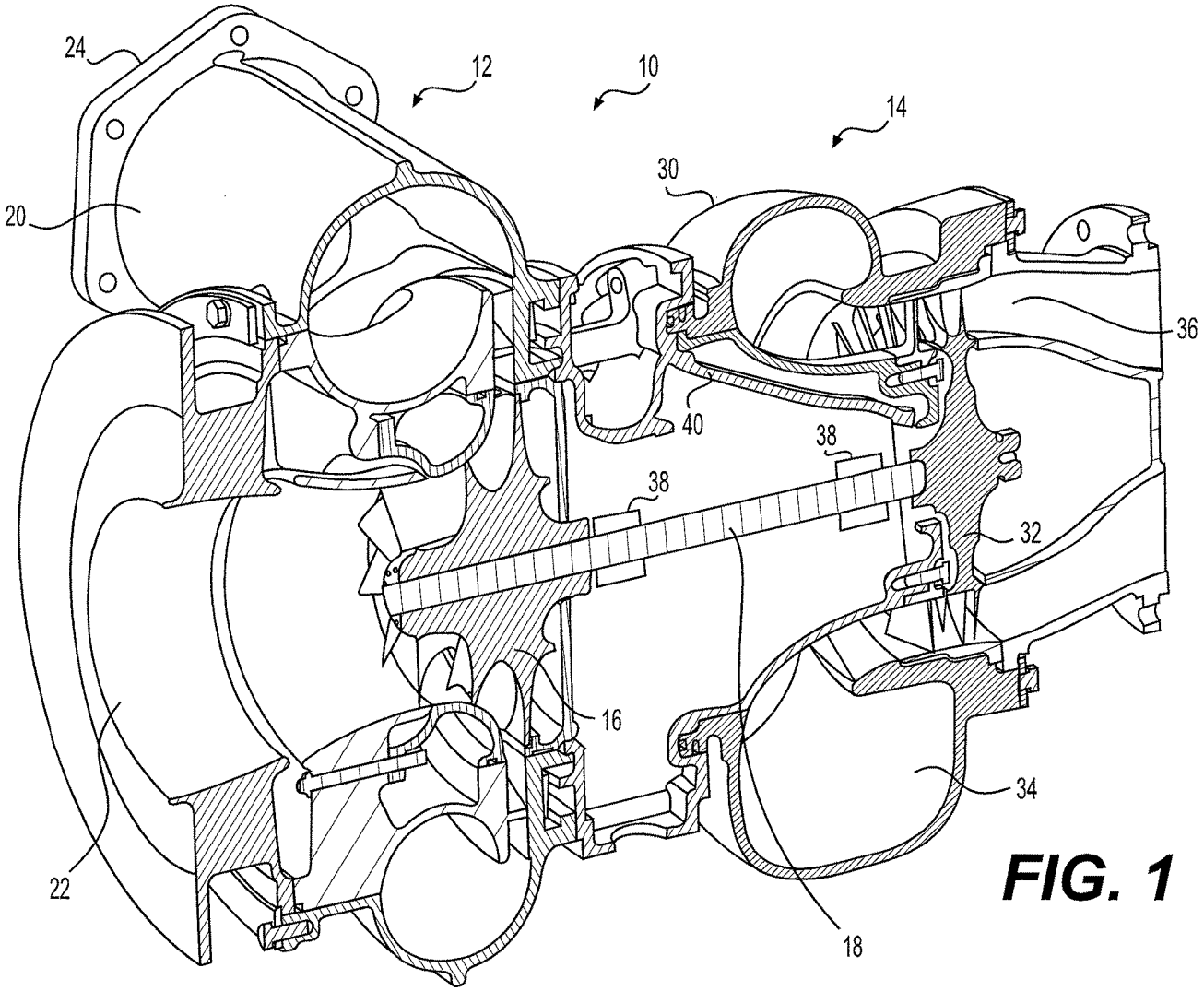
FIG. 1 is a cut-away view of an exemplary disclosed turbocharger.

FIG. 1 illustrates an exemplary embodiment of a turbocharger 10. Turbocharger 10 may be used with an engine (not shown) of a machine that performs some type of operation associated with an industry such as railroad, marine, power generation, mining, construction, farming, or another industry known in the art. As shown in FIG. 1, turbocharger 10 may include compressor stage 12 and turbine stage 14. Compressor stage 12 may embody a fixed geometry compressor impeller 16 attached to shaft 18 and configured to compress air received from an ambient to a predetermined pressure level before the air enters the engine for combustion. Air may enter compressor housing 20 via compressor inlet 22 and exit compressor housing 20 via compressor outlet 24. As air moves through compressor stage 12, compressor impeller 16 may force compressed air into the engine.

Turbine stage 14 may include turbine housing 30 and turbine wheel 32, which may be attached to shaft 18, extending from compressor housing 20 to turbine housing 30. Exhaust gases exiting the engine may enter turbine housing 30 via turbine inlet 34 and exit turbine housing 30 via turbine outlet 36. As the hot exhaust gases move through turbine housing 30 and expand against the blades of turbine wheel 32, turbine wheel 32 may rotate compressor impeller 16 via shaft 18. Bearings 38 may support shaft 18. Bearings 38 may be disposed in bearing housing 40. Although FIG. 1 illustrates only two bearings 38, it is contemplated that turbocharger 10 may include any number of bearings 38.

Figure 2:
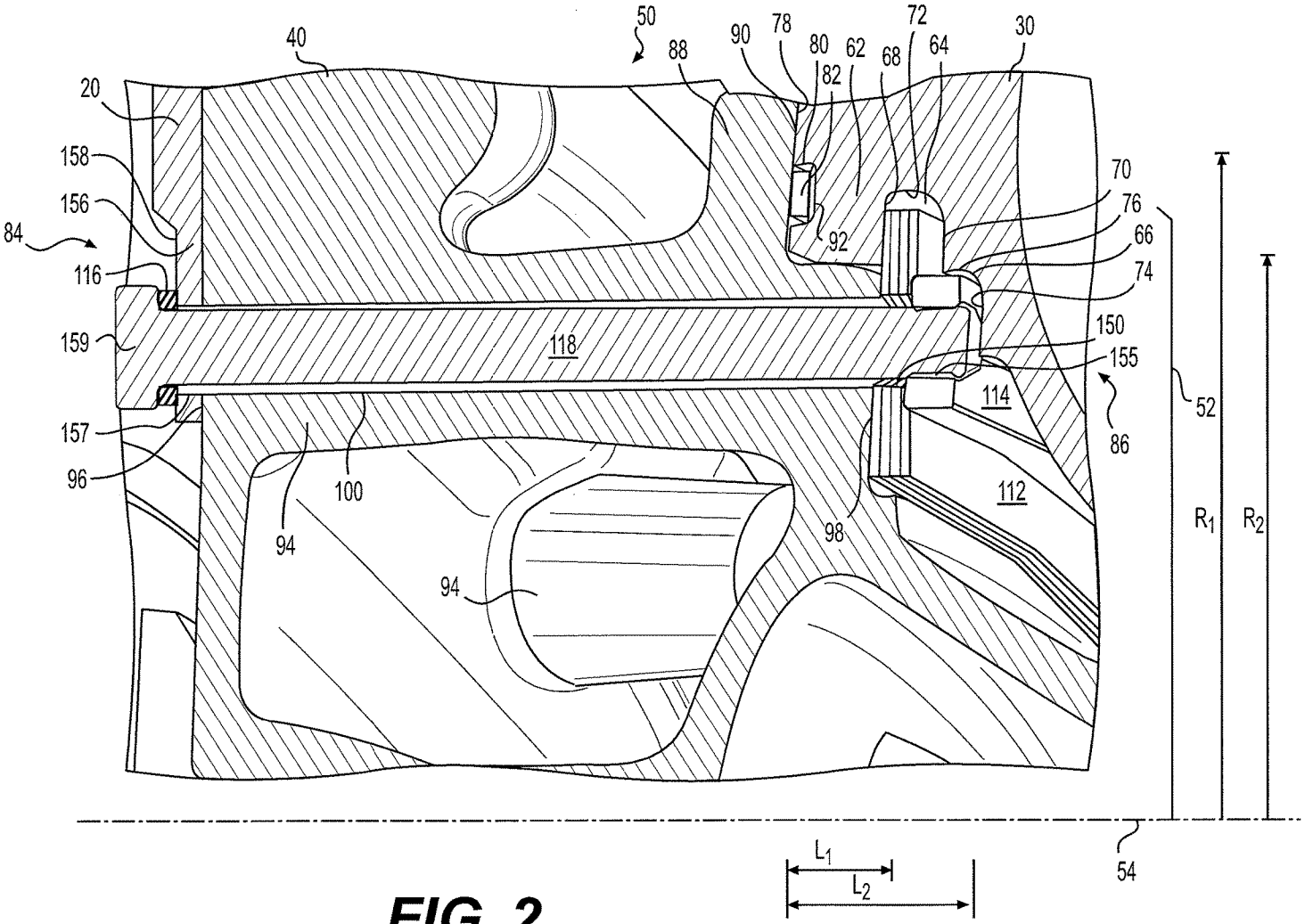
FIG. 2 is a cut-away view of an exemplary disclosed turbine housing assembly for the turbocharger of FIG. 1.

FIG. 2 illustrates an exemplary embodiment of a turbine housing assembly 50. Turbine housing assembly 50 may include compressor housing 20, turbine housing 30, bearing housing 40, and turbine housing connection 52, all of which may be disposed around a rotational axis 54 of shaft 18. Turbine housing 30 may include a turbine housing flange 62. Turbine housing 30 may also include first annular recess 64 and second annular recess 66. First annular recess 64 may have a front recess wall 68 and first rear recess wall 70 opposite front recess wall 68. First annular recess 64 may also have a circumferential inner surface 72, extending from front recess wall 68 to first rear recess wall 70. Inner surface 72 may have a generally cylindrical shape with a radius "R1." It is contemplated, however, that inner surface 72 may have a conical, elliptical, or any other shape known in the art. Second annular recess 66 may have a second rear recess wall 74. Second annular recess 66 may also have a circumferential inner surface 76 extending from first rear recess wall 70 to second rear recess wall 74. Inner surface 76 may have a generally cylindrical shape with a radius "R2." It is contemplated, however, that inner surface 76 may have a conical, elliptical, or any other shape known in the art. In one exemplary embodiment as illustrated in FIG. 2, radius R1 may be larger than radius R2. Front recess wall 68, first rear recess wall 70, and second rear recess wall 74 may be generally orthogonal to rotational axis 54. It is contemplated, however, that one or more of front recess wall 68, first rear recess wall 70, and second rear recess wall 74 may be disposed at a different angle relative to rotational axis 54.

As illustrated in FIG. 2, turbine housing flange 62 may include front flange wall 78 disposed opposite front recess wall 68. Front flange wall 78 may include a circumferential groove 80. Seal member 82 may be disposed within groove 80. In one exemplary embodiment, seal member 82 may be an annular ring having a rectangular cross-section. It is contemplated, however, that seal member 82 may have a square, polygonal, elliptical or any other type of cross-section known in the art. In another exemplary embodiment, seal member 82 may be an O-ring. As further illustrated in FIG. 2, first rear recess wall 70 may be disposed at an axial distance "L1" from front recess wall 68. Second rear recess wall 74 may be disposed at an axial distance "L2" from front recess wall 68. In one exemplary embodiment as illustrated in FIG. 2, L2 may be larger than L1.

Bearing housing 40 may extend from compressor end 84 to turbine end 86. Bearing housing 40 may include bearing housing flange 88, which may be disposed between compressor end 84 and turbine end 86. In one exemplary embodiment, bearing housing flange 88 may be disposed nearer turbine end 86 as compared to compressor end 84. It is contemplated, however, that bearing housing flange 88 may be disposed anywhere between compressor end 84 and turbine end 86. Bearing housing flange 88 may include a mating surface 90 which may abut on front flange wall 78 of turbine housing flange 62. As illustrated in FIG. 2, seal member 82 may be disposed between mating surface 90 and inner surface 92 of groove 80.

Bearing housing 40 may also include one or more bosses 94. Each boss 94 may extend from compressor end 84 to turbine end 86. Boss 94 may have a front face 96 adjacent compressor end 84 and a rear face 98 adjacent turbine end 86. Boss 94 may include a hole 100 extending from front face 96 to rear face 98. In one exemplary embodiment hole 100 may be a through hole. It is contemplated, however, that some or all portions of hole 100 may be threaded.

Figure 3:
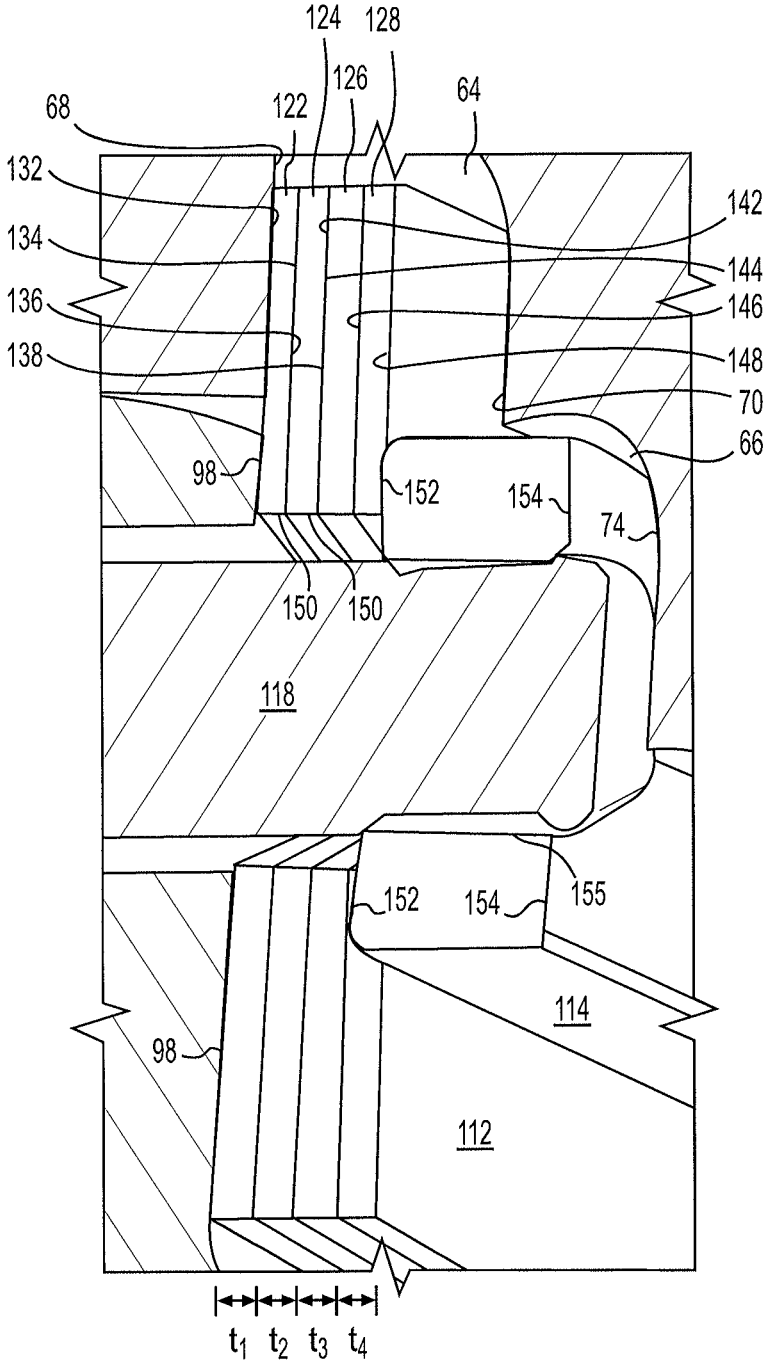
FIG. 3 is an illustration of an exemplary disclosed turbine housing connection for the turbine housing assembly of FIG. 2.

Turbine housing connection 52 may include clamping plates 112, backing plate 114, washer 116, and fastener 118. As illustrated in FIG. 2, turbine housing connection 52 may include a plurality of clamping plates 112, which may abut on each other. For example, as illustrated in FIG. 3, turbine housing connection 52 may include first clamping plate 122, second clamping plate 124, third clamping plate 126, and fourth clamping plate 128. First clamping plate 122 may have a first front face 132 and first rear face 134 disposed opposite first front face 132. First front face 132 may abut on front recess wall 68 of first annular recess 64. First front face 132 may also abut on rear face 98 of boss 94. Second clamping plate 124 may have a second front face 136 and a second rear face 138 opposite second front face 136. Second front face 136 of second clamping plate 124 may abut on first rear face 134 of first clamping plate 122. Third clamping plate 126 may have a third front face 142 and a third rear face 144 disposed opposite third front face 142. Third front face 142 of third clamping plate 126 may abut on second rear face 138 of second clamping plate 124. Fourth clamping plate 128 may have a fourth front face 146 and a fourth rear face 148 disposed opposite fourth front face 146. Fourth front face 146 of fourth clamping plate 128 may abut on third rear face 144 of third clamping plate 126. Fourth rear face 148 of fourth clamping plate 128 may be disposed opposite first rear recess wall 70.

First, second, third, and fourth clamping plates 122, 124, 126, 128 may have thicknesses "t1," "t2," "t3," and "t4," respectively. It is contemplated that thicknesses t1, t2, t3, t4 may be equal or may be different from each other. It is further contemplated that first, second, third, and fourth clamping plates 122, 124, 126, 128 may be made of the same material or different materials. The thickness and material of each of first, second, third, and fourth clamping plates 122, 124, 126, 128 may be selected based on the desired strength, performance, and wear characteristics at elevated temperatures. First, second, third, and fourth clamping plates 122, 124, 126, 128 may also include one or more holes 150, which may align with holes 100 in bosses 94. In one exemplary embodiment, holes 150 may be through holes. It is contemplated, however, that holes 150 may be threaded. Although, FIGS. 2 and 3 illustrate four clamping plates 122, 124, 126, 128, it is contemplated that turbine housing connection 52 may have any number of clamping plates.

Turbine housing connection 52 may include backing plate 114, which may have a front face 152 and a rear face 154 disposed opposite front face 152. Front face 152 of backing plate 114 may abut on fourth rear face 148 of fourth clamping plate 128. Rear face 154 of backing plate 114 may be disposed opposite second rear recess wall 74 of second annular recess 66. One of ordinary skill in the art will recognize that front face 152 of backing plate 114 may abut on first rear face 134 when turbine housing connection 52 includes only first clamping plate 122. Similarly, front face 152 of backing plate 114 may abut on second rear face 138 when turbine housing connection 52 includes both first and second clamping plates 122, 124. Further, front face 152 of backing plate 114 may abut on third rear face 144 when turbine housing connection 52 includes first, second, and third clamping plates 122, 124, 126. Backing plate 114 may include one or more holes 155, which may align with holes 100 in bosses 94 and holes 150 in clamping plates 112, 122, 124, 126, 128. In one exemplary embodiment, holes 155 may be threaded. It is contemplated, however, that holes 155 may be through holes.

Returning to FIG. 2, compressor housing 20 may have a compressor housing flange 156 that may abut on bearing housing 40 and on front face 96 of boss 94. Compressor housing flange 156 may include one or more holes 157, which may or may not be threaded. Holes 157 may align with holes 100 in bosses 94 and holes 150 in clamping plates. Washer 116 may be disposed on compressor housing flange 156 adjacent compressor end 84. In one exemplary embodiment as illustrated in FIG. 2, washer 116 may abut on front face 158 of compressor housing flange 156. Fastener 118 may include fastener head 159, which may abut on washer 116. Fastener 118 may also include threads adjacent turbine end 86. Threads in fastener 118 may engage with threads in hole 155 of backing plate 114 to attach compressor housing 20, turbine housing 30, and bearing housing 40. Using a plurality of clamping plates, for example, first, second, third, and fourth clamping plates 122, 124, 126, 128, may allow turbine housing connection 52 to attach compressor housing 20, turbine housing 30, and bearing housing 40 using moderate clamping loads relative to the clamping loads that may be required in the absence of first, second, third, and fourth clamping plates 122, 124, 126, 128. Turning fastener head 159 to engage threads in fastener 118 with threads in hole 155 may cause the one or more clamping plates 122, 124, 126, 128 to deflect slightly allowing tension load to be generated in fastener 118. Allowing the one or more clamping plates 122, 124, 126, 128 to deflect may allow compressor housing 20, turbine housing 30, and bearing housing 40 to be clamped with moderate clamping load while simultaneously allowing a prescribed tension load to be generated in fastener 118. The moderate clamping load between compressor housing 20, turbine housing 30, and bearing housing 40 may allow compressor housing 20, turbine housing 30, and bearing housing 40 to move relative to each other due to their differential thermal expansion without inducing fatigue in fastener 118, clamping plates 122, 124, 126, 128, or backing plate 114.

Figure 4:
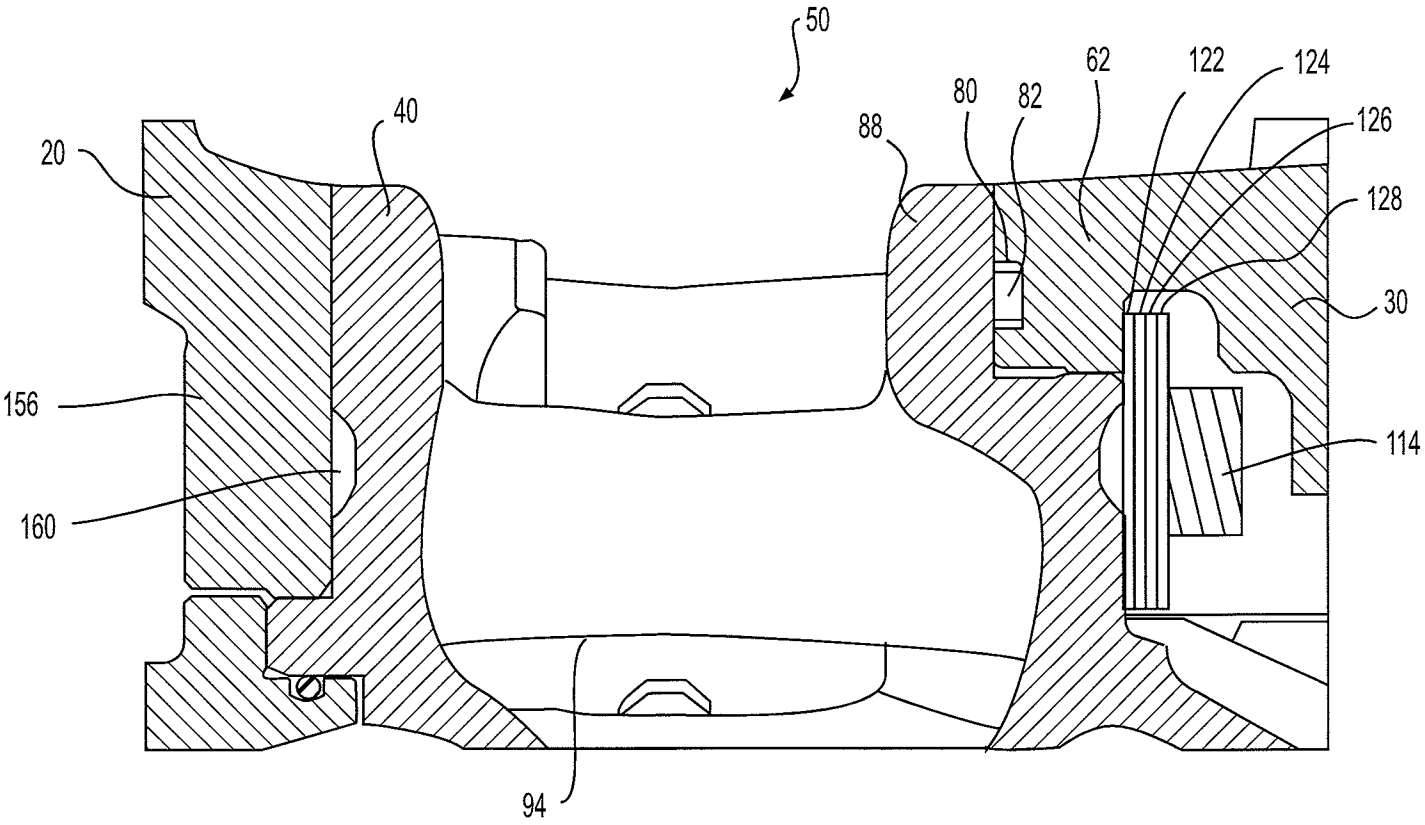
FIG. 4 is another cut-away view of the exemplary disclosed turbine housing assembly of FIG. 2.

FIG. 4 illustrates another view of the exemplary disclosed turbine housing assembly 50 of FIG. 2. As illustrated in FIG. 4, bearing housing 40 may include one or more grooves 160 disposed between compressor housing flange 156 and bearing housing 40, allowing compressor housing 20 to be in fluid communication with hole 100 (see FIG. 2) of boss 94. Cool air from compressor housing 20 may flow via groove 160 through hole 100 to cool boss 94, fastener 120, clamping plates 112, 122, 124, 126, 128, backing plate 114, bearing housing flange 88, and turbine housing flange 62, minimizing the temperature gradients in the connected components. Minimizing the temperature gradients in this manner may help reduce the differential expansion between compressor housing 20, turbine housing 30, and bearing housing 40, further reducing mechanical fatigue of the connected components. As is also apparent from FIG. 2, turbine housing connection 52 may be fully enclosed within compressor housing 20, turbine housing 30, and bearing housing 40. Enclosing turbine housing connection 52 within the compressor, turbine, and bearing housings 20, 30, 40 may help prevent exposure of turbine housing connection 52 to moisture or other corrosive elements, which in turn may help to increase the useful life of turbine housing connection 52 and turbine housing assembly 50. Reducing the likelihood of corrosion of turbine housing connection 52 may also help minimize the need to repair and/or replace any of the components of turbine housing connection 52, thereby minimizing the cost of maintenance and operation of turbocharger 10.

Figure 5:
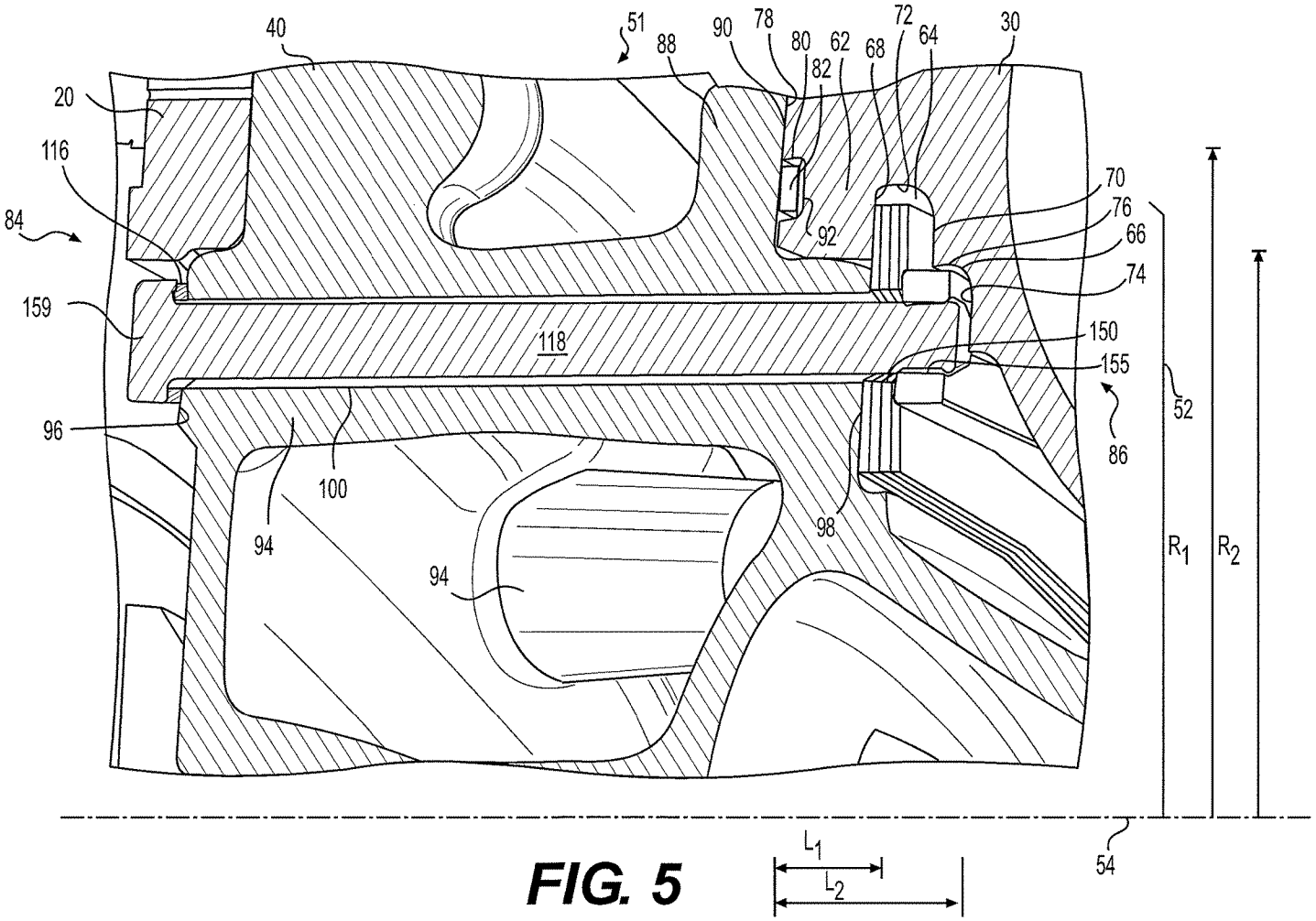
FIG. 5 is a cut-away view of another exemplary disclosed turbine housing assembly for the turbocharger of FIG. 1.

FIG. 5 illustrates another exemplary embodiment of a turbine housing assembly 51. Many of the components of turbine housing assembly 51 are similar to the components of turbine housing assembly 50 of FIG. 2. Only the portions of turbine housing assembly 51 that are different from turbine housing assembly 50 are described here. For example, unlike turbine housing assembly 50, turbine housing connection 52 of turbine housing assembly 51 may only connect turbine housing 30 and bearing housing 40. Turbine housing connection 52 may include washer 116 disposed adjacent compressor end 84. Washer 116 may abut on front face 96 of boss 94. Fastener 118 may include fastener head 159 which may abut on washer 116. Fastener 118 may also include threads adjacent turbine end 86. Threads in fastener 118 may engage with threads in hole 155 of backing plate 114 to attach turbine housing 30 to bearing housing 40. Using a plurality of clamping plates, for example, first, second, third, and fourth clamping plates 122, 124, 126, 128, may allow turbine housing connection 52 to attach turbine housing 30 with bearing housing 40 using moderate clamping loads relative to the clamping loads that may be required in the absence of first, second, third, and fourth clamping plates 122, 124, 126, 128. Turning fastener head 159 to engage threads in fastener 118 with threads in hole 155 may cause the one or more clamping plates 122, 124, 126, 128 to deflect slightly allowing tension load to be generated in fastener 118. Allowing the one or more clamping plates 122, 124, 126, 128 to deflect may allow turbine housing 30 and bearing housing 40 to be clamped with moderate clamping load while simultaneously allowing a prescribed tension load to be generated in fastener 118. The moderate clamping load between turbine housing 30 and bearing housing 40 may allow turbine housing 30 and bearing housing 40 to move relative to each other due to their differential thermal expansion without inducing fatigue in fastener 118, clamping plates 122, 124, 126, 128, or backing plate 114.

Bearing housing 40 may include one or more grooves 160 (similar to that shown in FIG. 4), which may allow compressor housing 20 to be in fluid communication with hole 100 of boss 94. Cool air from compressor housing 20 may flow via groove 160 through hole 100 to cool boss 94, fastener 120, clamping plates 112, 122, 124, 126, 128, backing plate 114, bearing housing flange 88, and turbine housing flange 62, minimizing the temperature gradients in the connected components. Minimizing the temperature gradients in this manner may help reduce the differential expansion between turbine housing 30 and bearing housing 40, further reducing mechanical fatigue of the connected components. As is also apparent from FIG. 5, turbine housing connection 52 may be fully enclosed within compressor housing 20, turbine housing 30, and bearing housing 40. Enclosing turbine housing connection 52 within the compressor, turbine, and bearing housings 20, 30, 40 may help prevent exposure of turbine housing connection 52 to moisture or other corrosive elements, which in turn may help to increase the useful life of turbine housing connection 52 and turbine housing assembly 51. Reducing the likelihood of corrosion of turbine housing connection 52 may also help minimize the need to repair and/or replace any of the components of turbine housing connection 52, thereby minimizing the cost of maintenance and operation of turbocharger 10.

Figure 6:
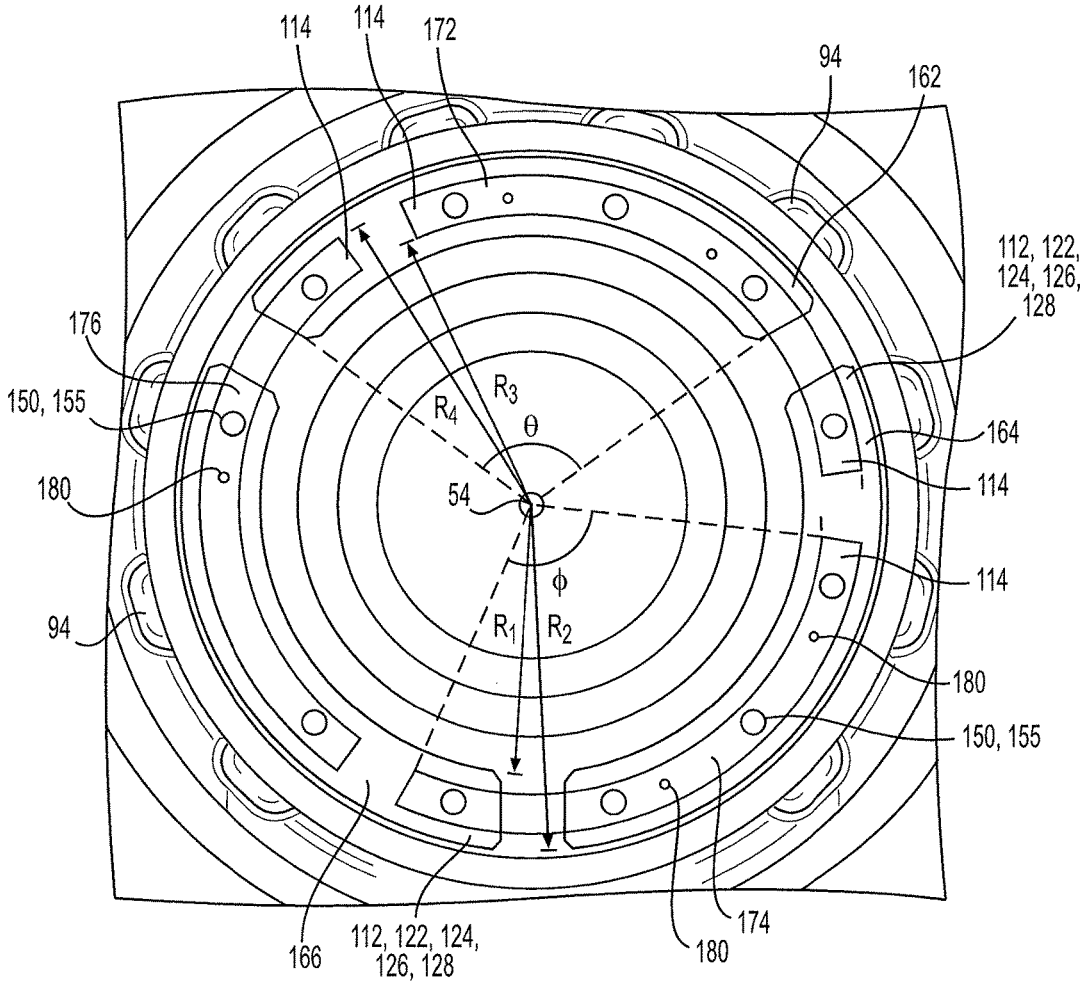
FIG. 6 is a diagrammatic rear view of the exemplary disclosed turbine housing assemblies of FIGS. 2 and 5.

FIG. 6 illustrates a rear view of turbine housing assembly 50 or turbine housing assembly 51 as viewed from turbine end 86. As illustrated in FIG. 6, each of clamping plates 112, 122, 124, 126, 128 may include a plurality of arc-shaped clamping plate segments. For example, as shown in FIG. 6, fourth clamping plate 128 may include first clamping plate segment 162, second clamping plate segment 164, and third clamping plate segment 166. Each of first second and third clamping plate segments 162, 164, 166 may be an annular arc-shaped plate having holes 155. As illustrated in FIG. 6, first, second, and third clamping plate segments may be circumferentially disposed so as to circumscribe rotational axis 54 so that holes 155 may also be circumferentially disposed around rotational axis 54. In one exemplary embodiment as illustrated in FIG. 6, each of first second and third clamping plate segments 162, 164, 166 may include four holes 155 circumferentially spaced equidistant from each other. It is contemplated, however, that each of first second and third clamping plate segments 162, 164, 166 may include any number of holes 155, which may or may not be disposed equidistant from each other. Each of first, second, and third clamping plate segments 162, 164, 166 may have an inner radius "R1" and an outer radius "R2" greater than R1. It is contemplated, however, that first, second, and third clamping plate segments 162, 164, 166 may have the same or different radii R1 and R2. Each of first, second, and third clamping plate segments 162, 164, 166 may span an angle "θ." It is contemplated, however, that first, second, and third clamping plate segments 162, 164, 166 may span the same or different angles θ. Although three clamping plate segments have been illustrated in FIG. 6, it is contemplated that fourth clamping plate 128 may have any number of arc-shaped clamping plate segments. Further, although first, second, and third clamping plate segments 162, 164, 166 have been discussed with reference to fourth clamping plate 128, it is contemplated that first, second, and third clamping plates 122, 124, 126 may have a similar segmented plate structure.

As further illustrated in FIG. 6, backing plate 114 may also have a plurality of arc-shaped backing plate segments. For example, backing plate 114 may include first backing plate segment 172, second backing plate segment 174, and third backing plate segment 176. Each of first, second, and third backing plate segments 172, 174, 176 may be an annular arc-shaped plate having holes 155. As illustrated in FIG. 6, first, second, and third backing plate segments may be circumferentially disposed so as to circumscribe rotational axis 54 so that holes 155 may be circumferentially disposed around rotational axis 54. In one exemplary embodiment as illustrated in FIG. 6, each of first, second, and third backing plate segments 172, 174, 176 may include four holes 155 circumferentially spaced equidistant from each other. It is contemplated, however, that first, second, and third backing plate segments 172, 174, 176 may include any number of holes 155, which may or may not be disposed equidistant from each other. First, second, and third backing plate segments 172, 174, 176 may be arranged so that holes 155 align with holes 150. Each of first, second, and third backing plate segments 172, 174, 176 may have an inner radius "R3" and an outer radius "R4" greater than R3. It is contemplated, however, that first, second, and third backing plate segments 172, 174, 176 may have the same or different radii R3 and R4. Each of first, second, and third backing plate segments 172, 174, 176 may span an angle "ϕ." It is contemplated, however, that first, second, and third backing plate segments 172, 174, 176 may span the same or different angles ϕ. It is also contemplated that angle ϕ may be the same as or different from θ. Although three backing plate segments have been illustrated in FIG. 6, it is contemplated that backing plate 114 may have any number of arc-shaped backing plate segments. It is also contemplated that backing plate 114 may have a first number of arc-shaped backing plate segments which may be different from a second number of arc-shaped clamping plate segments of one or more of first, second, third, or fourth clamping plates 122, 124, 126, 128.

One or more rivets 180 may be used to attach one or more of first, second, third, and fourth clamping plates 122, 124, 126, 128 and backing plate 114. It is contemplated that cap screws, drive screws, or any other type of fastener known in the art may be used to attach one or more of first, second, third, and fourth clamping plates 122, 124, 126, 128 and backing plate 114. As also illustrated in FIG. 6, one or more of first, second, and third backing plate segments 172, 174, 176 of backing plate 114 may overlap more than one of first, second, and third segments 162, 164, 166 of fourth clamping plate 128. For example, as illustrated in FIG. 6, first backing plate segment 172 may overlap first and second clamping plate segments 162, 164. Similarly, second backing plate segment 174 may overlap second and third clamping plate segments 164, 166, and third backing plate segment 176 may overlap third and first clamping plate segments 166, 162.

INDUSTRIAL APPLICABILITY

The disclosed turbine housing assemblies may be implemented to connect a compressor housing, a turbine housing, and a bearing housing of a turbocharger associated with an internal combustion engine. The disclosed turbine housing assemblies 50, 51 may offer an improved connection compressor housing 20, turbine housing 30, and bearing housing 40 by allowing attachment of these components to each other using moderate loads. The moderate loads may allow relative radial movement between these components during operation of turbocharger 10, minimizing the mechanical fatigue induced in the components of turbine housing assemblies 50, 51. Further, the disclosed turbine housing assemblies 50, 51 may offer an improved connection between compressor housing 20, turbine housing 30, and bearing housing 40 by allowing cool air from compressor housing 20 to flow through bosses 94 in bearing housing 40. The cool air may cool the connected components of turbine housing assemblies 50, 51 helping to minimize the differential thermal expansion between turbine housing 30 and bearing housing 40. In addition, the disclosed turbine housing assemblies 50, 51 may offer an improved connection between compressor housing 20, turbine housing 30, and bearing housing 40 by enclosing turbine housing connection 52 within compressor housing 20, turbine housing 30, and bearing housing 40, thereby minimizing exposure of turbine housing connection 52 to moisture and other corrosive elements. Minimizing the exposure of turbine housing connection 52 to moisture and corrosive elements may help increase the useful life of turbine housing connection 52 and reduce the need to repair and/or replace the components of turbine housing connection 52, thereby helping to reduce the operational and maintenance costs for turbocharger 10.

Referring to FIGS. 2, 3, 4, and 6 during assembly of turbocharger 10, using turbine housing assembly 50, arc-shaped segments of first, second, third, and/or fourth clamping plates 122, 124, 126, 128, and backing plate 114 may be inserted in first and second annular recesses 64, 66, respectively. Rivets 180 may be used to hold the arc-shaped segments of first, second, third, and/or fourth clamping plates 122, 124, 126, 128, and backing plate 114 together. The arc-shaped segments of first, second, third, and/or fourth clamping plates 122, 124, 126, 128, and backing plate 114 may be arranged so that holes 150 and 157 may be aligned. Further, the arc-shaped segments of first, second, third, and/or fourth clamping plates 122, 124, 126, 128, and backing plate 114 may be arranged so that each of first, second, and third backing plate segments 172, 174, 176 may overlap at least two of the arc-shaped segments of first, second, third, and/or fourth clamping plates 122, 124, 126, 128. Threaded guides may be used to temporarily attach the arc-shaped segments of first, second, third, and/or fourth clamping plates 122, 124, 126, 128, and backing plate 114 to turbine housing 30. One or more of the threaded guides may be removed at a time and replaced by fasteners 118. Fasteners 118 may pass through holes 157 in compressor housing flange 156, holes 100 in bosses 94, and holes 150 in first, second, third, and/or fourth clamping plates 122, 124, 126, 128 and engage with the threads in holes 155 of backing plate 114 to attach compressor housing 20, turbine housing 30, and bearing housing 40. Turning fastener heads 159 may cause the arc-shaped sections of first, second, third, and/or fourth clamping plates 122, 124, 126, 128 to deflect, generating tension loads in fasteners 118. Further, use of threaded holes 155 in backing plate 114 may allow assembly of compressor housing 20, turbine housing 30, and bearing housing 40 without the need for additional tools, for example, a second wrench to turn a bolt engaging with the threads of fastener 118.

Referring to FIGS. 1 and 2, during engine operation as exhaust gases pass through turbine housing 30, a temperature of turbine housing 30 may increase. Cool air may pass through compressor housing 20, helping to maintain compressor housing 20 at a relatively lower temperature compared to the temperature of turbine housing 30. Bearing housing 40, being disposed between compressor housing 20 and turbine housing 30, may reach a temperature lower than that of turbine housing 30 and higher than that of compressor housing 20. Cooler air from compressor housing 20 may flow via grooves 160 through holes 100 in bosses 94 of bearing housing 40 and cool turbine housing connection 52. The cooler air may help to cool compressor housing flange 156, turbine housing flange 62 and bearing housing flange 88, helping to minimize the differential expansion between compressor housing 20, turbine housing 30, and bearing housing 40. The use of a plurality of clamping plates 122, 124, 126, 128 may allow a prescribed tension load to be generated in fasteners 118 while simultaneously clamping compressor housing flange 156, turbine housing flange 62, and bearing housing flange 88 with moderate clamping load. The moderate clamping load may allow compressor housing flange 156, turbine housing flange 62, and bearing housing flange 88 to move relative to each other due to the differential thermal expansion between these components without inducing excessive mechanical fatigue on fasteners 118.

Referring to FIGS. 3, 4, 5, and 6 during assembly of turbocharger 10, using turbine housing assembly 51, arc-shaped segments of first, second, third, and/or fourth clamping plates 122, 124, 126, 128, and backing plate 114 may be inserted in first and second annular recesses 64, 66, respectively. Rivets 180 may be used to hold the arc-shaped segments of first, second, third, and/or fourth clamping plates 122, 124, 126, 128, and backing plate 114 together. The arc-shaped segments of first, second, third, and/or fourth clamping plates 122, 124, 126, 128, and backing plate 114 may be arranged so that holes 150, 155, and 157 may be aligned. Further, the arc-shaped segments of first, second, third, and/or fourth clamping plates 122, 124, 126, 128, and backing plate 114 may be arranged so that each of first, second, and third backing plate segments 172, 174, 176 may overlap at least two of the arc-shaped segments of first, second, third, and/or fourth clamping plates 122, 124, 126, 128. Threaded guides may be used to temporarily attach the arc-shaped segments of first, second, third, and/or fourth clamping plates 122, 124, 126, 128, and backing plate 114 to turbine housing 30. One or more of the threaded guides may be removed at a time and replaced by fasteners 118. Fasteners 118 may pass through holes 100 in bosses 94 and holes 150 in first, second, third, and/or fourth clamping plates 122, 124, 126, 128 to engage with the threads in holes 155 of backing plate 114 to attach bearing housing 40 to turbine housing 30. Turning fastener heads 159 may cause the arc-shaped sections of first, second, third, and/or fourth clamping plates 122, 124, 126, 128 to deflect, generating tension loads in fasteners 118. Further, use of threaded holes 155 in backing plate 114 may allow assembly of bearing housing 40 to turbine housing 30 without the need for additional tools, for example, a second wrench to turn a bolt engaging with the threads of fastener 118.

Referring to FIGS. 1 and 5, during engine operation as exhaust gases pass through turbine housing 30, a temperature of turbine housing 30 may increase. Cool air may pass through compressor housing 20, helping to maintain compressor housing 20 at a relatively lower temperature compared to the temperature of turbine housing 30. Bearing housing 40, being disposed between compressor housing 20 and turbine housing 30, may reach a temperature lower than that of turbine housing 30 and higher than that of compressor housing 20. Cooler air from compressor housing 20 may flow via grooves 160 through holes 100 in bosses 94 of bearing housing 40 and cool turbine housing connection 52. The cooler air may also help to cool turbine housing flange 62 and bearing housing flange 88, helping to minimize the differential expansion between turbine housing 30, and bearing housing 40. The use of a plurality of clamping plates 122, 124, 126, 128 may allow a prescribed tension load to be generated in fasteners 118 while simultaneously clamping turbine housing flange 62 and bearing housing flange 88 with moderate clamping load. The moderate clamping load may allow turbine housing flange 62 to move relative to bearing housing flange 88 due to the differential thermal expansion between the two components without inducing excessive mechanical fatigue on fasteners 118.

It will be apparent to those skilled in the art that various modifications and variations can be made to the disclosed turbine housing assembly. Other embodiments will be apparent to those skilled in the art from consideration of the specification and practice of the disclosed turbine housing assembly. It is intended that the specification and examples be considered as exemplary only, with a true scope being indicated by the following claims and their equivalents.

What is claimed is:

1. A turbine housing assembly, comprising:
a turbine housing including a turbine housing flange;
a bearing housing including:
a boss extending from a compressor end to a turbine end opposite the compressor end; and
a bearing housing flange abutting on the turbine housing flange, the bearing housing flange being disposed between the compressor end and the turbine end;
a clamping plate abutting on the turbine housing flange and the boss;
a backing plate abutting on the clamping plate; and
a fastener disposed within the boss and attached to the backing plate.

2. The turbine housing assembly of claim 1, wherein
the backing plate includes a threaded hole
the fastener includes threads that engage with the threaded hole.

3. The turbine housing assembly of claim 1, wherein
the bearing housing flange has a mating surface, and
the turbine housing flange has front flange wall abutting on the mating surface.

4. The turbine housing assembly of claim 3, wherein the turbine housing further includes:
a first annular recess having a front recess wall and a first rear recess wall disposed opposite the front recess wall, the first rear recess wall being located at a first axial distance from the front flange wall;
a second annular recess having a second rear recess wall disposed at a second axial distance from the front flange wall, the second axial distance being larger than the first axial distance.

5. The turbine housing assembly of claim 4, wherein
the clamping plate is disposed in the first annular recess, and
the backing plate is disposed in the second annular recess.

6. The turbine housing assembly of claim 4, wherein the clamping plate is a first clamping plate having a first front face and a first rear face opposite the first front face, and the turbine housing assembly includes:
a second clamping plate disposed in the first annular recess, the second clamping plate having a second front face and a second rear face opposite the second front face, wherein
the second front face of the second clamping plate abuts on the first rear face of the first clamping plate, and
the second rear face of the second clamping plate abuts on the backing plate.

7. The turbine housing assembly of claim 6, wherein
the first clamping plate has a first thickness, and
the second clamping plate has a second thickness different from the first thickness.

8. The turbine housing assembly of claim 6, wherein
the first clamping plate is made of a first material, and
the second clamping plate is made of a second material different from the first material.

9. The turbine housing assembly of claim 3, wherein
the turbine housing includes a circumferential groove on the front flange wall, and
a seal member is disposed in the circumferential groove.

10. The turbine housing assembly of claim 9, wherein the seal member is an O-ring.

11. The turbine housing assembly of claim 1, wherein the clamping plate includes a first plurality of clamping plate segments disposed circumferentially relative to a rotational axis.

12. The turbine housing assembly of claim 11, wherein the backing plate includes a second plurality of backing plate segments disposed circumferentially relative to the rotational axis.

13. The turbine housing assembly of claim 12, wherein at least one of the second plurality of backing plate segments overlaps at least two of the first plurality of clamping plate segments.

14. A turbocharger, comprising:
a turbine housing, including:
a turbine housing flange having a front flange wall;
a first annular recess having a front recess wall and a first rear recess wall opposite the front recess wall, the first rear recess wall being located at a first axial distance from the front flange wall; and
a second annular recess having a second rear recess wall disposed at a second axial distance from the front flange wall, the second axial distance being larger than the first axial distance;
a turbine wheel disposed within the turbine housing and configured to be rotated by exhaust received from an engine;
a bearing housing, including:
at least one boss extending from a compressor end to a turbine end opposite the compressor end; and
a bearing housing flange having a mating surface abutting on the front flange wall of the turbine housing flange;
a compressor housing including a compressor housing flange abutting on the bearing housing, the compressor housing flange having a first hole;
a shaft attached to the turbine wheel, the shaft extending from the turbine housing to the compressor housing;
a compressor impeller disposed within the compressor housing, the compressor impeller being disposed on the shaft and configured to be driven by the turbine wheel;
at least one clamping plate disposed in the first annular recess, the at least one clamping plate, including:
a second hole;
a front face abutting on the front recess wall; and
a rear face opposite the front face;
a backing plate abutting on the rear face of the at least one clamping plate, the backing plate including a third hole having threads; and
a fastener disposed within the at least one boss, the fastener passing through the first hole and the second hole and engaging the threads in the third hole to attach the compressor housing, the turbine housing, and the bearing housing.

* * * * *